United States Patent [19]

Silverman et al.

[11] 4,014,468

[45] Mar. 29, 1977

[54] SQUEEZE BOTTLE DISPENSER WITH IMPROVED DIP TUBE AND METHOD OF ASSEMBLING SAME

[75] Inventors: Paul Silverman; William R. Bartuska, both of Skokie, Ill.

[73] Assignee: Helene Curtis Industries, Inc., Chicago, Ill.

[22] Filed: May 5, 1975

[21] Appl. No.: 574,605

[52] U.S. Cl. ..... 239/327

[51] Int. Cl.² ..... B65D 1/32

[58] Field of Search ..... 239/327, 434, 369, 354; 222/109, 193, 215, 511, 211

[56] References Cited

UNITED STATES PATENTS

| | | | |
|---|---|---|---|
| 2,642,313 | 6/1953 | Montenier | 239/327 X |
| 2,658,797 | 11/1953 | Montenier | 239/327 |
| 2,981,444 | 4/1961 | Root | 239/327 |
| 3,014,666 | 12/1961 | Verbouwens | 239/327 |
| 3,140,052 | 7/1964 | McCuiston | 239/327 |
| 3,649,334 | 8/1953 | Schneider | 239/327 |
| 3,676,060 | 4/1954 | Montenier | 239/327 |

*Primary Examiner*—Robert B. Reeves
*Assistant Examiner*—Norman L. Stack
*Attorney, Agent, or Firm*—Dressler, Goldsmith, Clement, Gordon & Shore, Ltd.

[57] ABSTRACT

A squeeze bottle dispenser comprising a resilient squeeze bottle and a plug insert in the neck of the bottle. The plug insert receives a dip tube assembly comprising a dip tube and a short tube element adjacent the discharge orifice of the plug insert. The short tube element defines a passageway having a diameter of from about 0.014 to about 0.040 inch and is from about one-sixteenth to about 1 inch in length. The dip tube internal diameter is substantially greater than the diameter of the short tube element passageway. The short tube element may be inserted in the upper end of the dip tube or may abut the upper end of the dip tube. The making of the dip tube assembly comprises the steps of providing a short tube element and a long dip tube, and inserting the short element into the dip tube, with the upper ends of the element and tube being flush.

5 Claims, 7 Drawing Figures

Fig. 1.
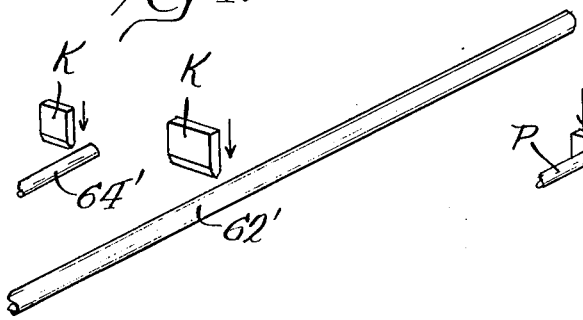
Fig. 2.
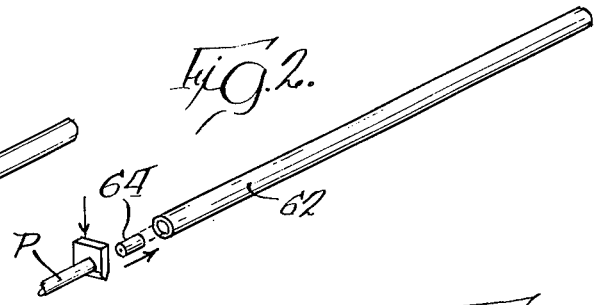
Fig. 7.
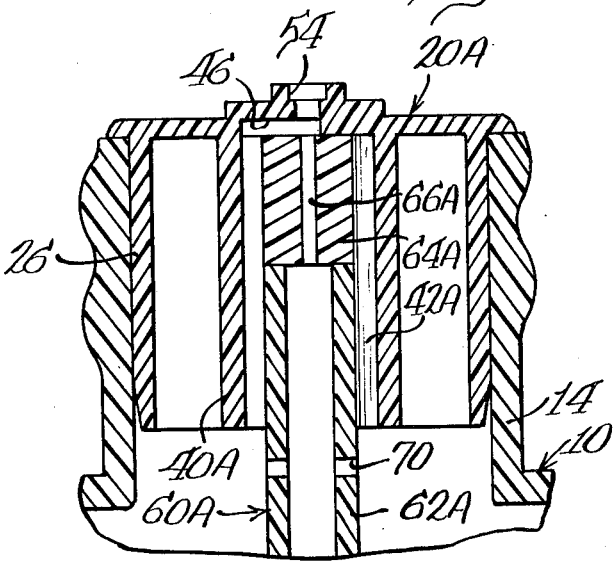
Fig. 4.
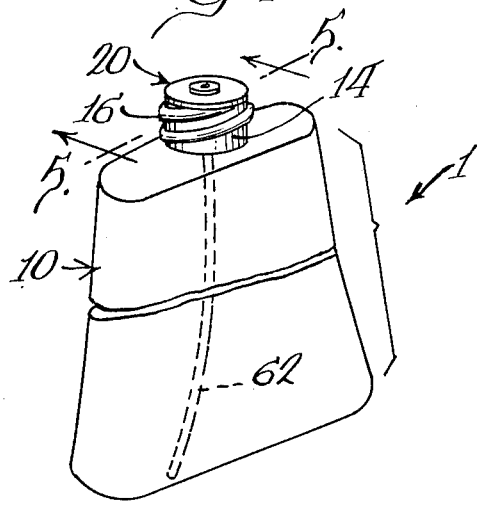
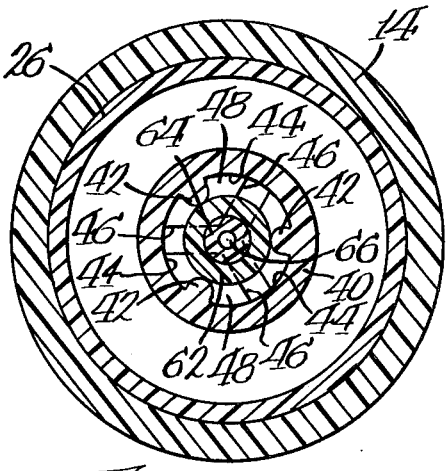
Fig. 5.
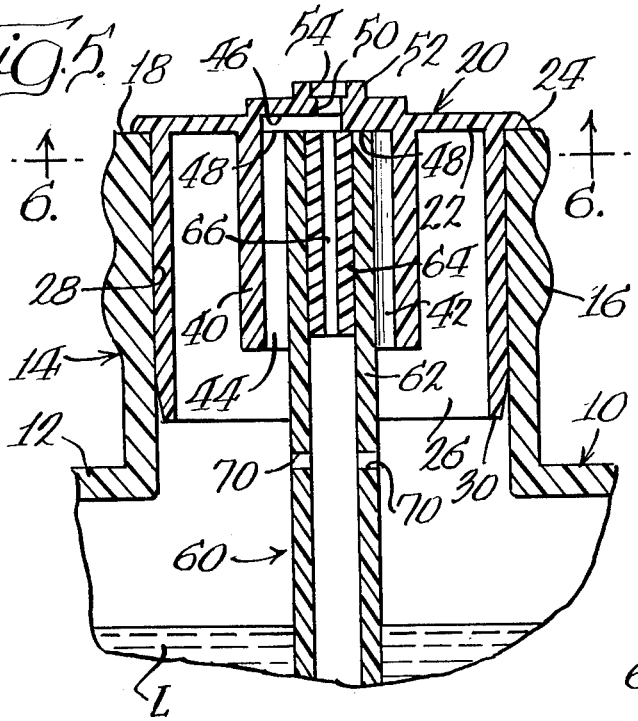
Fig. 6.
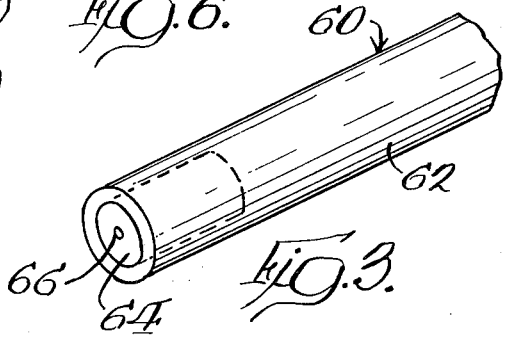
Fig. 3.

SQUEEZE BOTTLE DISPENSER WITH IMPROVED DIP TUBE AND METHOD OF ASSEMBLING SAME

This invention relates to squeeze bottle dispensers, and especially to squeeze bottle dispensers for dispensing deodorants and the like in the form of a finely-divided or atomized spray.

Efforts to provide squeeze bottles having effective means for atomizing the material to be dispensed has been the subject of considerable development work over the years. As a result of that effort, a wide variety of squeeze bottle dispensers have been made available for dispensing deodorants, powders, medicines, insecticides and the like. Indeed, a number of patents representative of a variety of efforts to provide effective squeeze bottle dispensers have issued, of which the Ryberg U.S. Pat. No. 2,573,731, Montenier U.S. Pat. Nos. 2,658,797, 2,642,313 and 2,676,060, Schneider U.S. Pat. No. 2,649,334, Robert U.S. Pat. No. 2,924,393 and McCuiston U.S. Pat. No. 3,140,052 are representative.

Nevertheless, the problem of securing effective atomization of the contents to be dispensed over the life of a squeeze bottle container has continued and this problem has contributed to the slow growth in the use of such dispensers and the preferential use of other types of dispensers, such as aerosol dispensers.

Squeeze bottle dispensers of this invention provide for substantially improved atomization of materials, such as deodorant liquids, which are to be dispensed from them. The improved atomization is accomplished by the provision of an improved and modified dip tubing assembly which is readily adapted for use with conventional squeeze bottles, and even with conventional squeeze bottle plug inserts.

A squeeze bottle assembly of this invention comprises a resilient squeeze bottle and an insert plug sealingly seated in the bottle neck. The insert plug has a flange defining a discharge orifice through which the bottle contents may be discharged. A depending plug skirt is provided for receiving and mounting a dip tube assembly.

The dip tube assembly comprises an elongate hollow dip tube extending downwardly from the skirt to adjacent the bottom of the squeeze bottle and a short tube element positioned against the lower surface of the plug insert flange. The short element defines a passageway which is in flow communication with a laterally extending metering slot in the flange at one end of the passageway and which is in flow communication with the hollow in the dip tube at its other end. The skirt and the dip tube assembly define an air passage therebetween which is also in flow communication with the laterally extending metering slot, thereby to provide for the admixture of air with the bottle contents adjacent the end of the dip tube assembly. The passageway through the short tube element is from about 0.014 to about 0.040 inch in diameter and preferably from about 0.020 to about 0.025 inch, which is substantially less than the diameter of the hollow in the dip tube. The length of the short tube element is from about one-sixteenth to about 1 inch, and preferably from about one-quarter to about one-half inch in length.

The short tube element may be disposed within the dip tube and may have the upper ends of the tube element and dip tube flush with each other and with the inner surface of the plug insert flange, or the lower end of the short tube element and the upper end of the dip tube may be in butting engagement, thereby to place the passageway and the hollow in flow communication.

One or more air taps may be provided in the dip tube. A plurality of metering slots may be provided and they may extend radially or may preferably extend tangentially.

The invention also comprises an improved method of forming dip tubing for use with squeeze bottles of the present invention. In accordance with that aspect of this invention, the steps of the method comprise providing a first short length of tubing having a first internal diameter and a first external diameter, providing a second substantially longer length of tubing having a second internal diameter substantially the same as the first external diameter, and inserting the first length into the second length so that one end of the first length is flush with a first end of the second length, and so that a second end of the first length is remote from the second end of the second length. Preferably the first ends lie in a common plane normal to the longitudinal axes of the lengths of tubing. The short length of tubing is from about one-sixteenth to about one inch in length and has an internal diameter of from about 0.014 to about 0.040 inch.

Further objects, features and advantages of this invention will become apparent from the following description and drawings, of which:

FIGS. 1 and 2 schematically illustrate a method of forming and assembling dip tubing for use in the squeeze bottle of FIG. 4;

FIG. 3 illustrates a preferred embodiment of assembled dip tubing of this invention;

FIG. 4 is a fragmentary view of a squeeze bottle of this invention;

FIG. 5 is a cross-sectional view taken substantially along the line 5—5 of FIG. 4;

FIG. 6 is a cross-sectional view taken substantially along the line 6—6 of FIG. 5; and FIG. 7 is a view, similar to FIG. 5, of a further embodiment of this invention.

Referring first to FIGS. 3 to 6, an improved squeeze bottle assembly of this invention comprises a resilient squeeze bottle 10 made of a suitably chemical-resistant material. If the bottle is to be used for the dispensing of spray deodorants linear polyethylene is a suitable material. The bottle is sufficiently flexible so that it may readily be squeezed by the average person to force the contents through the dip tubing and out the discharge orifice. It is resilient enough to return rapidly to its undeformed state and so that it draws replacement atomizing air inwardly as it returns to its undeformed shape.

Bottle 10 comprises a main body portion 12 which is provided with a neck 14 having suitable exterior threads 16 for engagement with a suitable closure cap (not shown). The mouth or upper surface 18 (FIG. 5) of the neck is proportioned to cooperate with a plug insert 20 formed of a suitable material, such as polyethylene. Plug insert 20 comprises an upper flange 22 which is proportioned to overlie and to bear against neck surface 18 inwardly of the peripheral edge 24 of flange 22. A depending generally cylindrical skirt 26, proportioned to bear against and to seal against the inner surface 28 of neck 14, is provided. Preferably, the lower portion 30 of skirt 26 is tapered to facilitate the insertion of the plug insert 20 into neck 14.

A further depending boss or skirt 40 is provided inwardly of skirt 26. Skirt 40 is generally cylindrical and depends from a central region of flange 22 and is proportioned to receive and hold the dip tubing to be described. The inner surface of skirt 40 provides a plurality of elongate projections 42 which are preferably three in number. Projections 42 serve, with the tubing to be described, to define air supply passages or grooves 44 and serve to grip and retain that dip tubing.

The inner central lower surface of flange 22, the portion which is circumscribed by skirt 40, defines lands and air metering grooves or slots 46. Slots 46 desirably extend radially, although they may extend tangentially with a discharge passage 50 as illustrated in Ryberg U.S. Pat. No. 2,573,731, and terminate outwardly in communication with the air supply grooves 44. The metering slots 46 communicate centrally with the discharge passage 50 and orifice 54 through which atomized liquid to be discharged from the squeeze bottle 10 passes. The central outer surface area of the flange 22 may be slightly thickened and may also be formed with an extension 52 thereby to provide a sufficiently long and suitably proportioned discharge passage 50. The discharge passage 50 terminates in a discharge orifice 54 which may be of larger dimension than that of the discharge passage itself, thereby appropriately to limit the spray pattern. In a typical suitable plug insert passage 50 may be 0.037 inch in diameter and the length of the passage 50 may be 0.032 inch.

Dip tube assembly 60 comprises elements 62 and 64. Elongate hollow dip tube element 62 extends downwardly from the plug insert 20 to the base of the bottle to serve as a conduit for conveying fluid from the bottom of the bottle upwardly into the plug insert 20. Dip tube element 62 may preferably be formed of polyethylene. Short tube element 64 may also be formed of polyethylene or of polypropylene or metal or other suitable material. It defines an internal passageway 66 of substantially less cross-sectional area than the cross-sectional area of dip tube element 62. In a preferred embodiment, tube element 64 is externally proportioned to be press fit into dip tube element 62 tightly enough so that it will not easily be displaced under normal usage of the squeeze bottle.

Dip tube assembly 60 may be preassembled, as illustrated by FIG. 3, for insertion into the plug insert 20 where it is retained and held within the skirt 40 by elongate projections 42, as shown by FIGS. 5 and 6. The uppermost surface of the dip tube assembly 60 is cut square to the axis of the tube elements so that its uppermost surface will preferably be positioned against, thereby to sealingly bear against, the land areas 48 bordering metering slots 46, thereby to control the amount of air to be admixed with the liquid or other material conveyed through the dip tube assembly adjacent the upper end of the dip tube assembly, so that when it is discharged, the material is properly atomized.

Where the introduction of additional air into the liquid to be discharged from the squeeze bottle is desirable, thereby to supplement the air expressed through the metering slots 46, or where premixture of some air with the liquid to be discharged is desired, one or more air taps 70 may be provided in long dip tube element 62.

The dip tube assembly 60 comprises an elongate hollow dip tube element 62 which may be of conventional dimension, such as about 0.080 inch in internal diameter. The tube element 64 may be from about one-sixteenth to 1 inch in length, and optimally is from one-quarter to one-half inch in length. In the embodiment of FIG. 5, the dip tube element 62 is three-eighths inch in length. The outer diameter of element 64 is approximately 0.080 inch so that it may be sealingly seated within dip tube element 62. The internal passageway 66 of tube element 64 may be from about 0.014 to about 0.040 inch in diameter and optimally is from 0.020 to 0.025 inch in diameter.

Dip tube assemblies 60 in accordance with this invention have been made and tested. It has been found that the atomization achieved when a dip tube assembly 60 has been substituted for an ordinary dip tube about 0.080 inch in internal diameter with the same plug insert is very substantially improved. Further, when a dip tube having a discharge passageway of the dimension of passageway 66 was substituted for a dip tube element 62, no discharge occurred because the diameter was so small that liquid could not effectively be forced upwardly through the full length of dip tubing when the bottle was squeezed. Only when a short length 64 of very small diameter tubing is utilized with a piece of dip tubing 62 of generally conventional dimension is discharge with the highly effective atomization in accordance with this invention accomplished.

FIG. 7 illustrates another embodiment of this invention in which a short length of a tube element having a small diameter internal passageway is associated with a long dip tube element to provide for atomization comparable to that of the embodiment of FIGS. 3 to 6. In FIG. 7, a squeeze bottle 10 having a neck 14 is fitted with a plug insert 20A. Plug insert 20A may be identical to plug insert 20 except for the fact that the inner skirt 40A and projections 42A are somewhat longer.

A dip tube assembly 60A comprises a dip tube element 62A and a short tube element 64A. The outer diameter of the tube elements 62A and 64A are substantially the same so that both will be suitably gripped and retained by the projections 42A. The length of short tube element 64A may be the same as was that of short tube element 64 and the passageway 66A may be of the same dimension as was the passageway 66 of short tube element 64.

To assemble the squeeze bottle assembly of FIG. 7, the short tube element 64A is first inserted to the position illustrated, following which the dip tube element 62A is seated to assume the position illustrated in FIG. 7. The confronting lower end of element 64A and the upper end of element 62A are cut square and are in butting engagement and preferably sealingly engage each other to place them in flow communication and so that the amount of air to be mixed with the liquid is controlled by the dimensions of the metering slots 46. Provision for additional air to be admixed with the liquid may be made by air taps, such as air taps 70.

A dip tube assembly 60 may conveniently and effectively be preassembled for use in the squeeze bottle assembly of FIGS. 3 to 6 in the manner schematically illustrated by FIGS. 1 and 2. As there shown, supplies of polyethylene tubing 62' and 64' are provided. They are cut, as by knives K, into suitable lengths comprising elements 62 and 64. Element 64 is then pushed into an element 62, as by a pusher member P, and as schematically illustrated by FIG. 2, when they are so assembled they become the assembly 60 shown in FIG. 3. In that relationship one end of each lies in a common plane normal to the longitudinal axes of the lengths of tubing with the other ends being remote from each other. That assembly is then ready to be inserted into a plug insert 20, to assume the position and relationship best illustrated by FIG. 5.

Although the elements 62 and 64 may each be separately cut and then assembled, it is also possible to insert a continuous length of tubing 64' into the open end of a continuous length of tubing 62', following which they are then severed into appropriate lengths from the continuous lengths.

It will be apparent from the foregoing that further embodiments of this invention may be made without departing from the spirit and scope of the invention. Accordingly the scope of the invention is to be considered as being limited only in accordance with the claims.

What is claimed is:

1. A squeeze bottle assembly comprising: a resilient squeeze bottle having a main body portion and a neck, a plug insert sealingly seated in said neck, said plug insert comprising an upper flange defining a discharge orifice at its outer surface through which contents of said bottle may be discharged, and a depending skirt for receiving a dip tube assembly, said flange defining at least one laterally extending metering slot in its lower surface in communication with said discharge orifice, said slot terminating laterally outwardly adjacent said skirt, and a dip tube assembly disposed and held within said depending skirt, said dip tube assembly comprising an elongate hollow dip tube extending downwardly from said skirt to adjacent the bottom of said main body portion and a short tube element positioned against lower surface of said flange and defining a passageway which is in flow communication with said metering slot at one end and which is in flow communication with the hollow in said dip tube at its other end, said skirt and said dip tube assembly defining air passage means therebetween which is also in flow communication with said laterally extending slot, thereby to provide for the mixture of air with bottle contents conveyed through the dip tube assembly adjacent the upper end of the dip tube assembly and wherein the passageway through said short tube element is from about 0.014 to about 0.040 inch in diameter, which diameter is substantially less than the diameter of the hollow in said dip tube, wherein said short tube element is from about one-sixteenth to about 1 inch in length, and wherein said short tube element is disposed within said elongate dip tube and the upper ends of said element and said dip tube lie in a common plane and are flush with each other and with said lower surface of said flange.

2. A squeeze bottle in accordance with claim 1 wherein the internal diameter of said short tube element passageway is from about 0.020 to about 0.025 inch and its length is from about one-quarter to about one-half inch in length.

3. A squeeze bottle in accordance with claim 1 wherein said skirt is generally cylindrical and provides a plurality of elongate projections, and wherein said projections grip said dip tube assembly at radially spaced locations and define, with said dip tube assembly, a plurality of air passages comprising said air passage means, each said air passage being in flow communication with a laterally extending metering slot in said lower surface of said flange.

4. A squeeze bottle in accordance with claim 3 in which said short tube element is from about one-quarter to about one-half inch in length and wherein the internal diameter of said short tube passageway is from about 0.02 to 0.025 inch.

5. A squeeze bottle in accordance with claim 3 in which said dip tube defines at least one air tap.

* * * * *

UNITED STATES PATENT AND TRADEMARK OFFICE

CERTIFICATE OF CORRECTION

PATENT NO. : 4,014,468

DATED : March 29, 1977

INVENTOR(S) : Paul Silverman and William R. Bartuska

It is certified that error appears in the above–identified patent and that said Letters Patent are hereby corrected as shown below:

In the References Cited:

"3,649,334" of 8/1953 should be -- 2,649,334 --;

"3,676,060" of 4/1954 should be -- 2,676,060 --;

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*